US008134439B2

(12) United States Patent
Scherer et al.

(10) Patent No.: US 8,134,439 B2
(45) Date of Patent: Mar. 13, 2012

(54) SOLENOID

(75) Inventors: Georg J. Scherer, Kirchheim (DE); Helmut J. Mang, Memmingen (DE)

(73) Assignee: Dipl-Ing. Wolfgang E. Schultz, Memmingen (DE)

( * ) Notice: Subject to any disclaimer, the term of this patent is extended or adjusted under 35 U.S.C. 154(b) by 363 days.

(21) Appl. No.: 12/232,086

(22) Filed: Sep. 10, 2008

(65) Prior Publication Data

US 2009/0066451 A1 Mar. 12, 2009

(30) Foreign Application Priority Data

Sep. 11, 2007 (DE) ..... 10 2007 043 046

(51) Int. Cl.
*H01F 7/00* (2006.01)
*H01F 3/00* (2006.01)
*H01F 7/08* (2006.01)

(52) U.S. Cl. ..... 335/278; 335/251; 335/255; 335/260; 335/281; 335/282; 336/196

(58) Field of Classification Search ..... 335/78–86, 335/128, 292, 299, 220–282; 336/196, 192, 336/198; 250/129.09, 129.15; 290/47–48; 74/6, 18, 18.1, 18.2
See application file for complete search history.

(56) References Cited

U.S. PATENT DOCUMENTS

| | | | | | |
|---|---|---|---|---|---|
| 2,922,614 | A * | 1/1960 | Nickells | 251/54 |
| 3,435,733 | A * | 4/1969 | Enke | 92/97 |
| 3,612,547 | A * | 10/1971 | Kan | 277/563 |
| 4,015,883 | A * | 4/1977 | Taylor | 384/484 |
| 4,111,441 | A * | 9/1978 | Sick et al. | 277/566 |
| 4,188,040 | A * | 2/1980 | Wolf et al. | 277/625 |
| 4,225,294 | A * | 9/1980 | Kakuwa et al. | 418/142 |
| 4,984,812 | A * | 1/1991 | Wada et al. | 277/560 |
| 5,126,712 | A * | 6/1992 | Sugiyama | 335/278 |
| 5,139,274 | A * | 8/1992 | Oseman | 277/552 |
| 6,420,950 | B1 * | 7/2002 | Kleinert et al. | 335/260 |
| 2005/0098400 | A1 * | 5/2005 | Kleinert et al. | 188/300 |
| 2007/0035373 | A1 * | 2/2007 | Henry et al. | 336/198 |

* cited by examiner

*Primary Examiner* — Mohamad Musleh
(74) *Attorney, Agent, or Firm* — Jacobson Holman PLLC

(57) ABSTRACT

A solenoid, in particular for switching pressure controllers or pressure valves, including an armature movable in an armature space, and a coil which can be impinged by current. When the coil is impinged by current, a magnetic field is generated serving for moving the armature, and the armature space can be filled with oil. For de-airing the armature space at least one de-airing channel is provided. In the de-airing channel at least one backflow-preventing element is provided which is permeable in the direction of de-airing.

4 Claims, 3 Drawing Sheets

SOLENOID

BACKGROUND OF THE INVENTION

Figure 1:
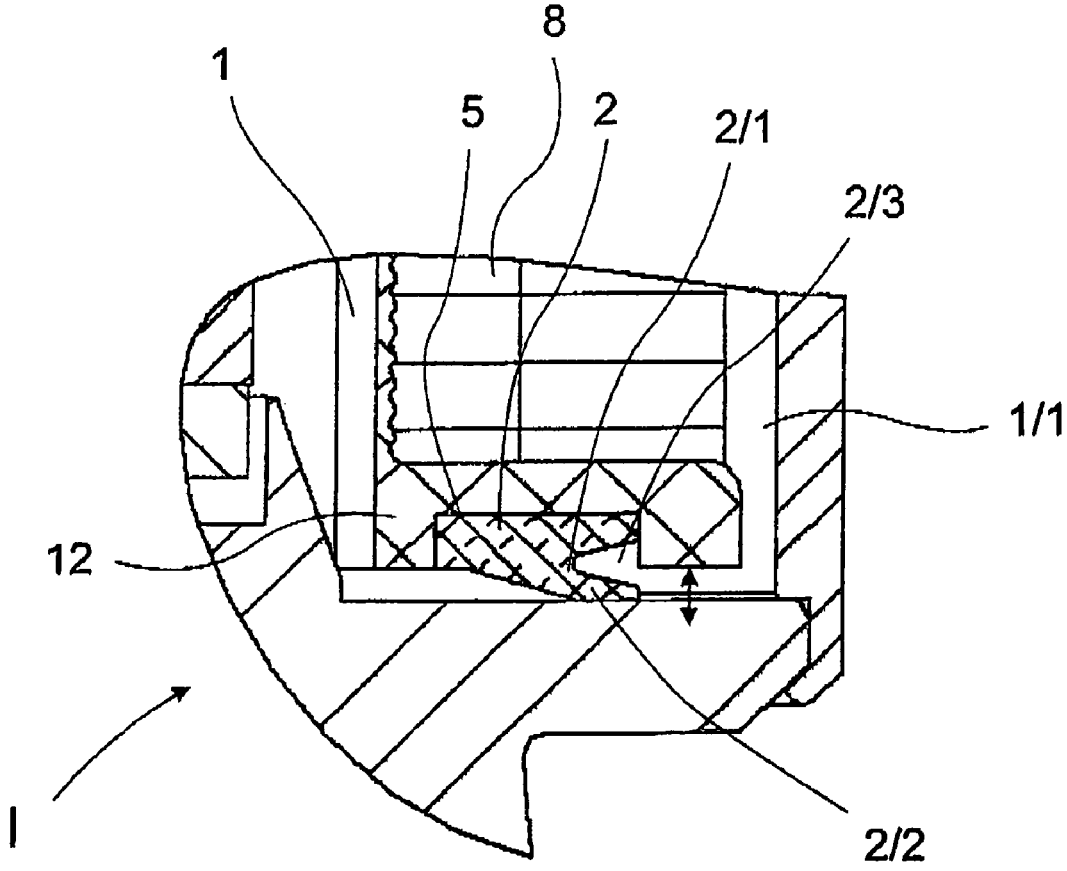

The invention refers to a solenoid, in particular for switching pressure controllers or pressure valves, comprising an armature movable in an armature space and a coil which can be impinged by current, wherein the coil generates a magnetic field serving for the movement of the armature when impinged by current, and the armature space can be filled with oil, and wherein for de-airing the armature space at least one de-airing channel is provided.

With pressure valves it is necessary for preventing self-oscillations of the control pressure at by the armature space being filled preferably completely with oil in order to reach a hydraulic damping of the armature movement. In a delivery condition the armature space is filled. It is known in the state of the art to carry out the filling of the armature through the openings of the not yet mounted adjusting pin for the adjustment of the armature. For that purpose on the coil form flange a spiral-shaped sealing is arranged for the de-airing through which the air can escape when the armature space is filled. After that the sealing prevents the armature space from emptying.

Furthermore solutions are known where a completely sealed armature space is filled with oil by means of vacuum filling. This is expensive and needs a lot of effort in respect of installations and has technical disadvantages.

BRIEF SUMMARY OF THE INVENTION

Coming from this state of the art it is an object of the invention to simplify the filling process of the armature space of a solenoid with oil.

The problem of the invention is solved by a solenoid, in particular for switching pressure controllers or pressure valves, comprising an armature movable in an armature space, and a coil which can be impinged by current, wherein the coil when impinged by current generates a magnetic field serving for the movement of the armature, and the armature space can be filled with oil, and wherein for de-airing the armature space at least one de-airing channel is provided which is characterised in that in the de-airing channel at least one element is provided which is permeable in a de-airing direction and prevents backflow.

By this design of the solenoid according to the invention the de-airing channel, on the one hand, may be opened now during filling in order to let escape still remaining air from the armature space, on the other hand, however, the backflow of oil or soilings is prevented. Thus not only the problem of the invention with respect to the de-airing of the armature space is solved during the filling with oil, but at the same time also an oil reduction and an oil change of the filling is prevented. Furthermore another advantageous effect is reached, namely that because of this design which prevents backflow, it is also prevented that soilings so to say with a backflow can get in the armature space. By this solution it is thus guaranteed that in the armature space there is always unpolluted oil which cannot be soiled, either, by soilings from outside. In the state of the art this was the case as because of the partly open design it was still possible that soilings could get in the armature space. Thus, for example, in the design with the spiral-shaped sealing already a part of the soilings has been caught in the siphon, however, this solution could not exclude that still soilings could get in the armature space. Only with the solution in the state of the art of vacuum filling working with a lot of effort also soiling was prevented.

The element preventing backflow here fulfils essentially also the function of a nonreturn valve. This lets pass, for example in the direction of flow, that means in the direction of de-airing, air and liquid, but is closed in the reverse direction.

An advantageous development of the invention suggests that the de-airing channel is part of the coil form or is arranged in the de-airing channel in the coil form itself. Here a space-saving arrangement and at the same time also an arrangement of the de-airing channel which can be realised technically and mechanically easily is planned. By the arrangement of the de-airing channel in the coil form or at the coil form it is possible to assemble the solenoid relatively space-saving altogether.

According to a modification of the invention it is possible here that the de-airing channel is provided at or in the flange of the coil form or in or at the siphon which is connected to the flange. There also the de-airing channel can be arranged without further required space, if necessary together with other components for the backflow-preventing element.

A development of the invention is given by the fact that the de-airing channel is provided in the core which extends between coil form and armature. Here also a space-saving arrangement is possible so that also without any problems space can be made for the backflow-preventing element.

The invention is characterised according to a development also in that the backflow-preventing element is provided in the coil form and/or the flange and/or the core. Depending on which modification is chosen for the de-airing channel as described before, the backflow-preventing element is then arranged accordingly.

Another aspect of the invention is given by the fact that the backflow-preventing element is provided as nonreturn valve. A nonreturn valve can here be constructed rather simply. It does not necessarily have to have a complicated design such, as it is known, for example, from plant engineering. As a nonreturn valve in the simplest embodiment it is provided according to the invention that it is designed as a lip seal. The lip seal can be here arranged in the de-airing channel in such a way that at least one lateral lip seals the de-airing channel, and this is in such a way that a backflow is impossible. On the other side actually, if the lip seal is arranged in such a way that the side of the lip facing outwards projects in the de-airing channel it is pushed away by the pressure coming from the armature space and thus makes de-airing possible.

A solenoid, as described before, is characterised in a development in that the lip seal has an extending limb projecting in the de-airing channel which takes over sealing on the side of the backflow. The extension is here provided angled in the direction of de-airing so that at the same time it is achieved that, on the one hand, de-airing can take place, and, on the other hand, however, a backflow is prevented.

It is preferred here that the lip seal is thickened like a wedge in the flow direction, and the thickening is slotted in the reverse direction of de-airing, preferably slotted wedge-like. By means of that quasi seen in cross-section a wedge-shaped sealing element which is created as a lip seal and which has a wedge-like recess so that one side of the thickening extends as a limb and can act so to say as a valve flap.

The invention suggests in another modification that the lip seal is arranged in a chamber of the de-airing channel which holds the lip. This chamber is here, as described further above, provided in the coil form as well as also in the flange or the core depending on where the de-airing channel passes.

Another aspect of the invention is given by the fact that the de-airing channel is locked by a reservoir at whose side facing the de-airing direction a boring is provided which ends in a conical running groove. In this groove then an O-ring is provided as a locking element or the element preventing the backflow. Through the conical design of the groove it is possible that the O-ring can move in flow direction while the backflow movement is blocked by the conical design, and thus a return of air and/or oil or soilings is prevented completely.

The invention also provides a pressure control valve with at least one solenoid, as described before.

BRIEF DESCRIPTION OF THE SEVERAL VIES OF THE DRAWINGS

Figure 2:
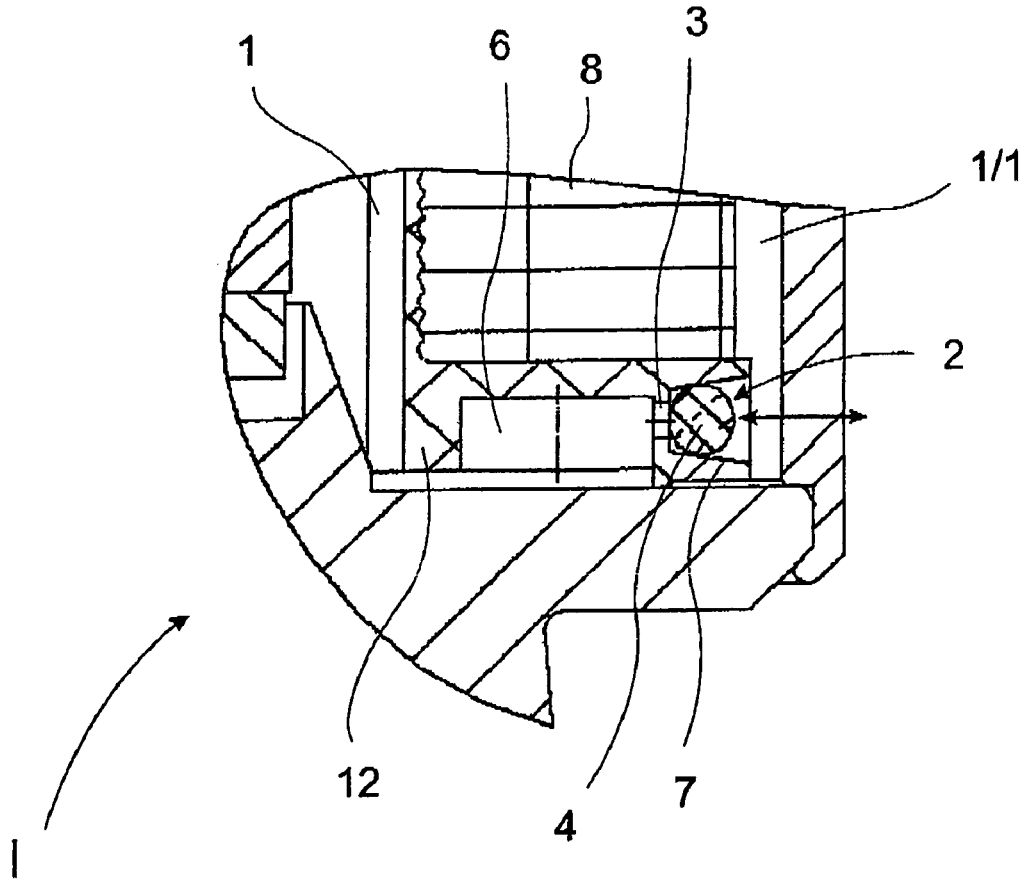

The invention is described in the following by means of examples and drawings. In the drawings:

FIG. 1: a detailed view of a first embodiment of the invention;

FIG. 2: another detailed view of a further embodiment of the invention and

Figure 3:
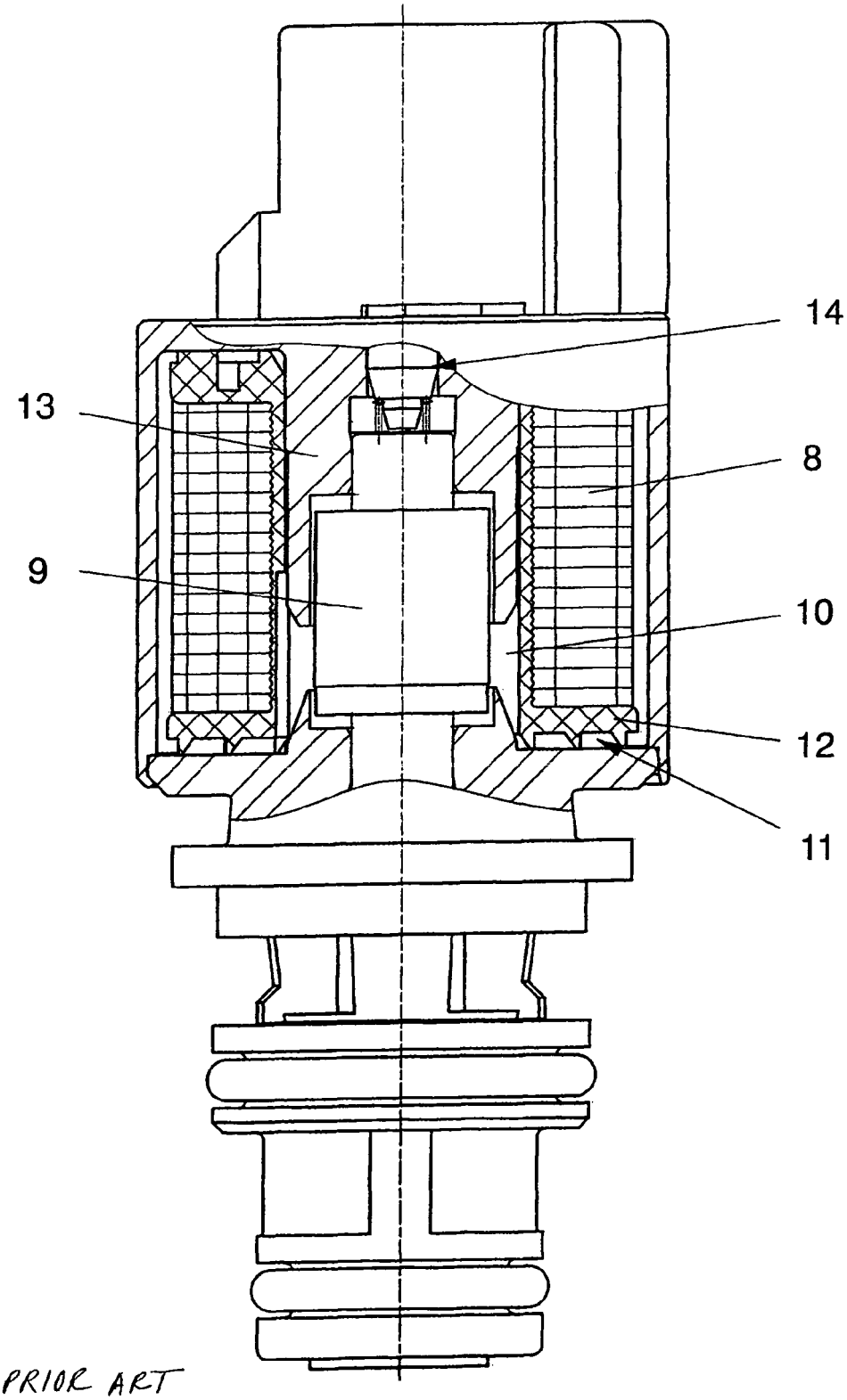
PRIOR ART Fig. 3

FIG. 3: a pressure control valve with solenoid according to the state of the art.

DETAILED DESCRIPTION OF PREFERRED EMBODIMENTS

FIG. 1 shows a detailed view of a first embodiment of the invention. Here only the first section of the solenoid I is shown which is essential for the invention. The de-airing channel is indicated here by 1. The side indicated by 1 (not shown here) faces the armature space 10 (see FIG. 3), and the side indicated by 1/1 of the de-airing channel is on the side to deair.

In the de-airing channel 1 in a chamber 5 a backflow-preventing element 2 designed as a lip seal and permeable in the direction of de-airing is provided. The backflow-preventing element 2 located in a cavity of flange 12 has here a thickening 2/1 running wedge-like in the direction of de-airing. In an opposite direction of de-airing the element 2 is slotted 2/3 wedge-like on its underside or slotted 2/3 wedge-like in the direction of flow so that a limb 2/2 forms. This limb 2/2 acts quasi as a valve flap. This is indicated with the double arrow on the right hand side beside the valve flap.

When now oil is filled in the armature space the air can escape via the de-airing channel 1 as by the building pressure in the armature space. Then the limb 2/2 is pushed away inwards and thus the air can escape. If the armature space 10 is filled completely with oil no additional pressure is generated so that the limb 2/2 is moved back again in the position in contact with the wall of the de-airing channel 1. If now from the side 1/1 of the de-airing channel air and/or soilings approach these cannot get anymore in the armature space 10 as, because of the design of the lip seal, this is pushed when impinged with pressure from the side of the de-airing channel 1/1 to the wall of the de-airing channel so that the sealing effects improves. Air, oil or soilings cannot get in anymore from this side. This modification which can be got quite simply reduces the effort for filling armature spaces for solenoids with oil considerably. The solenoid I according to the invention is therefore not only suited as a solenoid for pressure controllers but also for other solenoids which require in their armature space oil for lubricating and/or damping purposes.

FIG. 2 shows another embodiment of the solenoid I according to the invention which is only indicated schematically with an arrow. In this embodiment the backflow-preventing element 2 is designed differently than in the illustration of FIG. 1 described before. In a reservoir 6 designed in the de-airing channel 1 a boring 3 is provided. This boring 3 is here located in the bottom of the reservoir 6, that means in the direction to the outlet side 1/1 of the de-airing channel. The backflow-preventing element 2 is designed in this embodiment as an O-ring provided in a wedge-like groove 7 of the de-airing channel on the side 1/1. The double arrow and at the side of the O-ring indicates that this can move to the right when impinged by pressure from the side 1/1 of the de-airing channel. If there is pressure in the opposite direction from the side 1/1 of the de-airing channel then the O-ring is pushed again towards the boring 3 and thus seals. The O-ring 4 is here arranged in the wedge-shaped groove 7 so that it is pushed during movement to the left towards the wall of the groove 7 and in this way also here, besides the terminal sealing at the boring 3, already here a sealing effect occurs.

FIG. 3 shows a solution according to the state of the art wherein it can be seen in this figure where the armature space 10 with the armature 9 is located. Below the coil form 8 a flange 12 is arranged. At the flange 12 an annular sealing is arranged spiral-like. Filling of the armature space 10 with oil should be carried out through the adjusting pin 14, wherein the air can escape through the flange 12 in a spiral-shaped sealing via the siphon space 11. The coil form 8 is surrounded at least partly, by the core 13.

Although the invention has been described in terms of specific embodiments which are set forth in considerable detail, it should be understood that this is by way of illustration only and that the invention is not necessarily limited thereto, since alternative embodiments and operating techniques will become apparent to those skilled in that art in view of the disclosure. Accordingly, modifications are contemplated which can be made without departing from the spirit of the described invention.

The invention claimed is:

1. Solenoid for switching pressure controllers or pressure valves, comprising an armature movable in an armature space and a coil impingable by current, the coil generating a magnetic field serving for a movement of the armature when impinged by current, the armature space being fillable with oil, at least one de-airing channel for de-airing the armature space, and a flange located directly at one end of the coil, a backflow-preventing element being provided in a cavity of the flange, the cavity bordering the de-airing channel at the one end of the coil, the backflow-preventing element being a lip seal, the lip seal including a thickening in a direction of air flow, and the thickening being slotted, opposite to a direction of de-airing, the thickening being movable in the de-airing direction of air to allow air to move out of the de-airing channel and said thickening being movable to seal against backflow of air and soiling into the de-airing channel.

2. Solenoid according to claim 1, wherein the de-airing channel is part of a coil form or is arranged in the coil form.

3. Solenoid according to claim 1, wherein the de-airing channel is provided on or in the flange of a coil form or in or at a siphon space.

4. Pressure control valve with at least one solenoid according to claim claim 1.

* * * * *